US009145688B2

(12) United States Patent
Hunt-Hansen et al.

(10) Patent No.: US 9,145,688 B2
(45) Date of Patent: Sep. 29, 2015

(54) LATH SUPPORT SYSTEM

(75) Inventors: Mary Jane Hunt-Hansen, Grove, OK (US); Robert Wayne Love, Norphlet, AR (US); William Clyde Foster, Vancouver, WA (US); William L. Johnson, Sr., Grove, OK (US)

(73) Assignee: Spiderlath, Inc., Smackover, AK (US)

( * ) Notice: Subject to any disclaimer, the term of this patent is extended or adjusted under 35 U.S.C. 154(b) by 0 days.

(21) Appl. No.: 13/408,844

(22) Filed: Feb. 29, 2012

(65) Prior Publication Data

US 2012/0216481 A1 Aug. 30, 2012

Related U.S. Application Data

(62) Division of application No. 12/165,120, filed on Jun. 30, 2008, now abandoned.

(60) Provisional application No. 60/937,623, filed on Jun. 28, 2007.

(51) Int. Cl.

| | |
|---|---|
| ***E04F 13/04*** | (2006.01) |
| ***E04F 13/08*** | (2006.01) |
| ***E04B 2/84*** | (2006.01) |

(52) U.S. Cl.

CPC ..... *E04F 13/04* (2013.01); *E04B 2/845* (2013.01); *E04F 13/047* (2013.01); *E04F 13/0803* (2013.01); *E04F 13/045* (2013.01)

(58) Field of Classification Search

CPC ..... E04F 13/04; E04F 13/047; E04F 13/02; E04F 13/0803; E04F 13/0805; E04F 13/0892; E04F 13/045; E04B 2/842; E04B 2/845

USPC ..... 52/342, 343, 344, 408, 454

See application file for complete search history.

(56) References Cited

U.S. PATENT DOCUMENTS

| | | | |
|---|---|---|---|
| 932,099 | A | 8/1909 | Bender |
| 1,423,879 | A | 7/1922 | Potter |
| 1,444,709 | A | 2/1923 | Sea |
| 1,448,886 | A | 3/1923 | Walper |

(Continued)

FOREIGN PATENT DOCUMENTS

| | | |
|---|---|---|
| EP | 0018699 | 11/1980 |
| FR | 2359945 | 7/1976 |

(Continued)

*Primary Examiner* — Brian Glessner
*Assistant Examiner* — Babajide Demuren
(74) *Attorney, Agent, or Firm* — Fellers, Snider, Blankenship, Bailey & Tippens, P.C.

(57) ABSTRACT

A structural reinforcement system that utilizes a lath for receiving cementitious material. Lath is affixed to support structure such as sheathing supported by studs as may commonly be found in building construction. Strip members are affixed to the lath and function as fastener guides. Fasteners penetrate the strips for affixing lath and strips to the support structure. The strips are made of a compressible material that protects the lath from damage due to impacts associated with installing the fasteners and forms a gasket-like seal around the fasteners. Strips may be used as drainage guides for directing water that may flow behind the lath. The width of the strips creates spacing between the lath and the support structure, which allows for controlling of a thickness of a base layer of cementitious material by selecting a desired width. In another embodiment, entangled filaments are used as lath material for receiving cementitious material.

18 Claims, 7 Drawing Sheets

(56) References Cited

U.S. PATENT DOCUMENTS

| | | | |
|---|---|---|---|
| 1,569,144 | A | 1/1926 | Scammell |
| 1,592,807 | A | 7/1926 | Forrest |
| 1,802,779 | A | 4/1931 | Quade |
| 1,890,486 | A | 12/1932 | Angier |
| 2,020,908 | A | 11/1935 | Scammell |
| 2,021,036 | A | 11/1935 | Walper |
| 2,208,191 | A | 7/1940 | Kerr |
| 2,212,126 | A | 8/1940 | Phillips |
| 2,267,401 | A | 12/1941 | Gilmore |
| 2,929,239 | A | 3/1960 | Dahlhauser et al. |
| 2,983,080 | A | 5/1961 | Whiteside |
| 3,073,066 | A | 1/1963 | Edwards et al. |
| 3,145,001 | A | 8/1964 | Bruninga |
| 3,502,116 | A | 3/1970 | Crawford |
| 3,979,867 | A | 9/1976 | Sowinski |
| 4,062,160 | A | 12/1977 | Christison |
| 4,333,290 | A | 6/1982 | Koberstein |
| 4,379,798 | A | 4/1983 | Palmer et al. |
| 4,558,552 | A | 12/1985 | Reitter, II |
| 4,578,915 | A | 4/1986 | Schneller |
| 4,646,498 | A | 3/1987 | Schneller et al. |
| 4,866,897 | A | 9/1989 | Yount |
| 4,989,688 | A | 2/1991 | Nelson |
| 5,268,137 | A | 12/1993 | Scott et al. |
| 5,287,673 | A | 2/1994 | Kreikemeier |
| 5,481,843 | A | 1/1996 | Kreikemeier |
| 5,540,023 | A | 7/1996 | Jaenson |
| 5,552,207 | A | 9/1996 | Porter et al. |
| 5,598,673 | A | 2/1997 | Atkins |
| 5,697,195 | A | 12/1997 | Maylon |
| 5,763,043 | A | 6/1998 | Porter et al. |
| 5,839,241 | A | 11/1998 | Cacossa et al. |
| 5,906,081 | A | 5/1999 | Mantyla |
| 6,355,333 | B1 | 3/2002 | Waggoner et al. |
| 6,519,904 | B1 | 2/2003 | Phillips |
| 6,550,212 | B2 | 4/2003 | Lubker, II |
| 6,745,531 | B1 | 6/2004 | Egan |
| 6,807,786 | B1 | 10/2004 | Peck |
| 6,942,628 | B1 | 9/2005 | Watson |
| 7,036,284 | B1 | 5/2006 | Larson |
| 7,148,160 | B2 | 12/2006 | Porter |
| 7,625,827 | B2 | 12/2009 | Egan et al. |
| 2004/0074184 | A1 | 4/2004 | Naji |
| 2005/0246987 | A1 | 11/2005 | Hatzinikolas |
| 2006/0014457 | A1 | 1/2006 | Newton et al. |

FOREIGN PATENT DOCUMENTS

| | | |
|---|---|---|
| FR | 2556393 | 6/1985 |
| WO | WO9512717 | 5/1995 |
| WO | WO02066242 | 8/2002 |
| WO | WO2005060691 | 7/2005 |

FIG. 9
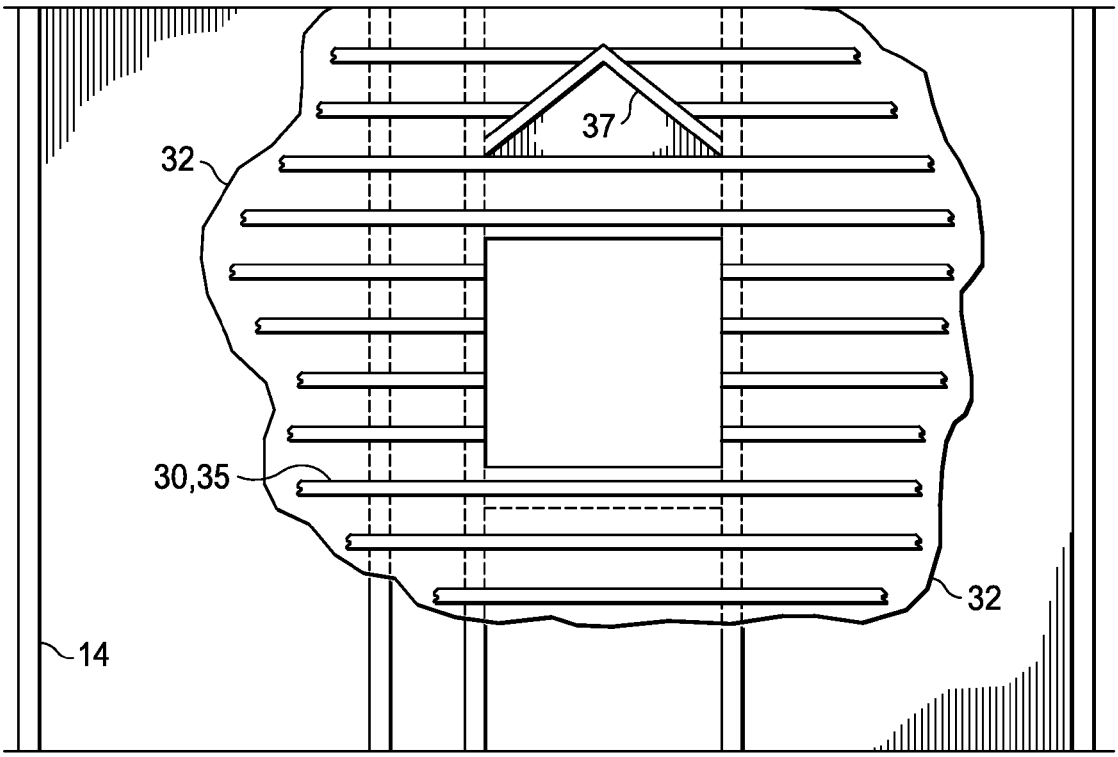
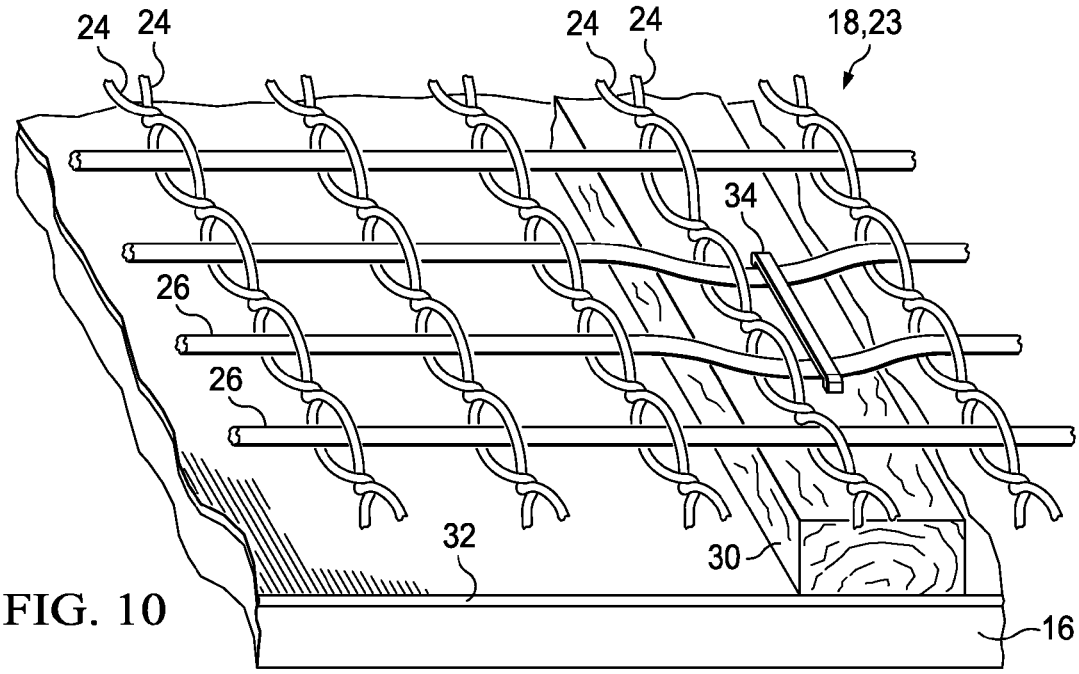
FIG. 10

LATH SUPPORT SYSTEM

CROSS REFERENCE TO RELATED APPLICATIONS

This application is a Divisional of U.S. Utility patent application Ser. No. 12/165,120, filed Jun. 30, 2008, entitled "LATH SUPPORT SYSTEM" which claims priority of U.S. Provisional Patent Application No. 60/937,623, entitled "NON-METALLIC MESH SUPPORT SUBSTRATE," filed Jun. 28, 2007, the contents of both of which are hereby incorporated by reference.

FIELD OF THE INVENTION

The present invention is directed to improvements in lath support systems for use in a variety of applications. The present invention is also directed to a method of applying lath and strip members as part of a structural reinforcement system.

BACKGROUND OF THE INVENTION

Plastering is one of the oldest crafts in the building trades. Plastering remains popular due to the durability and relatively low cost of materials. Plasterers apply plaster to interior walls and ceilings to form fire-resistant and relatively soundproof surfaces. A plaster veneer may also be applied over drywall to create smooth or textured abrasion-resistant finishes. In addition, prefabricated exterior insulation systems may be applied over existing walls. Stucco masons apply durable plasters, such as polymer-based acrylic finishes and stucco, to exterior surfaces.

Plasterers can plaster either solid surfaces, such as concrete block, or supportive wire mesh called lath. When plastering metal-mesh lath foundations, plasterers apply a preparatory, or "scratch coat" with a trowel. The scratch coat is spread into and over the lath. Before the plaster sets, plasterers scratch the surface of the scratch coat with a rake-like tool to produce ridges, so that the subsequent brown coat will bond tightly. The brown coat may then be applied. Later, the finish, or white coat is applied onto the scratch coat. Similar steps are followed when applying stucco and other materials to the lath.

The structure of the lath is what provides mechanical integrity to an overall masonry system. When mortar fills the small voids, it is called keying. Expanded lath has applications in the installation or manufacture of tile, countertops, shower surrounds, manufactured stone and natural stone veneers, brick, concrete stairs, and other masonry systems.

A commonly used lath material is metal lath. Metal lath is typically manufactured from steel sheets that are slit and expanded to form diamond shaped openings. The openings provide keys for securing plaster or a cementitious substrate such as stucco to the lath material, whether the base material is troweled on or mechanically applied. In addition, the shape of the orifice is designed to promote keying of the cementitious material to the lath.

If the metallic lath is weakened by corrosion, cracks tend to result in the cementatious material. In some cases, crack propagation may result in cracking of the stone, plaster, or stucco, which may be visible, unattractive, and unstable. Galvanized metal lath was introduced in an attempt to prolong the life of the metal lath in a corrosive cementitious environment. The corrosive effects resulted from moisture and alkalinity due to the lime content in cement based mortar. However, galvanized metal lath still has a tendency to rust and deteriorate, thus providing a substrate that is prone to fail.

Efforts have been made to develop non-metallic reinforcement systems and to use those systems for both structural and crack resistant properties. Fiberglass and plastic lathing systems have been introduced in the industry. The fiberglass and plastic lath have advantages, such as ease of handling, i.e., fiberglass and plastic lath come in rolls and are lighter than traditional metal lath, and the fiberglass and plastic lath does not rust. Additionally, plastic or fiberglass lath is easier to use because it may be cut with a sharp blade of a utility knife. Plastic lath is mainly used in the plaster and floor overlay applications. Examples of fiberglass and plastic lath include products sold under the trademark Ultra-lath®. Permalath® and Fiberlath are other fiberglass products used in structural reinforcement.

Fiberglass mesh, while not usually subject to corrosion, can be affected by the corrosive nature of cementitious material. For that reason, fiberglass mesh used as lath is usually coated with an alkali resistant material like zirconium dioxide to protect the fiberglass from the corrosive nature of many cementitious materials. The oxidation of fiberglass has been proven to not create structural degradation or mechanical weakening, unlike metallic materials embodied in cementitious material.

When constructing a wall system, studs are typically used to hold up the wall and sheathing is applied to the studs as a covering. To protect the sheathing, which is usually untreated wood, a vapor or water barrier is placed on the sheathing to stop moisture from reaching the untreated wood. Water/vapor barriers are usually tar paper, felt paper, plastic and more recently Tyvek® building wrap. If the water proofing layer is perforated, then the water barrier is compromised. Once water has penetrated the water barrier any untreated wood is susceptible to damage, such as dry rot and mold. One opportunity for perforating the water proofing layer is when structural support systems are applied over the water barrier and fastened to the substrate. In the fastening process the fasteners penetrate the water barrier, thus compromising the barrier and allowing a pathway for moisture to come in to contact with the wood sheathing. In the process of installing the lath as many as 200 penetrations in an 18 sq. ft. area may be found, thus causing irreparable damage to the water barrier and to the structural framing.

Additionally, when fasteners are in contact with moisture for prolonged period of time, such as water saturated wood, the galvanized anchors undergo corrosive fatigue and lose their structural integrity as a valid anchor or a mechanical fastener.

Therefore, it is desirable to provide an improved structural reinforcement system that provides integral waterproof sealing capabilities for anchor penetration through the water/vapor barrier.

It is further desirable to provide a structural reinforcement system that reduces the impact of the mechanical anchoring device during fastener application to prevent damage to the surface of the structural reinforcement system when secured to the anchoring point to prevent corrosion.

It is a further desirable to provide a structural reinforcement system that has adjustable nailing/mechanical fastening guides.

It is additionally desirable provide a structural reinforcement system that embodies a directional water drainage system in the structural reinforcement system. It is further desirable to provide an improved structural reinforcement system that has improved keying over conventional fiberglass lath.

It is additionally desirable to provide an improved flexible lath that has a profile that is three dimensionally uniform to provide improved keying of mortar and to facilitate a consistent and repeatable application a scratch coat to provide dimensional uniformity of the scratch coat.

SUMMARY OF THE INVENTION

This application relates to the field of structural concrete substrate. In one embodiment, a lath support system of the invention utilizes full encapsulation of a lath with a cementitious material such as concrete or mortar, wherein full encapsulation is defined as a layer of cementitious material behind the lath and a layer on top of the lath, forming a scratch coat which is applied simultaneously.

The lath support system utilizes strip members that function as fastener guides, which may be attached to the lath prior to installation. The lath may be used in conjunction with cementitious materials including stucco, plaster, tile, countertops, shower surrounds, manufactured stone and natural stone veneers, brick, concrete stairs, and other masonry systems.

As used herein, the term cementitious includes building materials having the characteristics of cement or mortar and include plaster, stucco, concrete, shotcrete, gunite, and may include adhesives. The system of the invention may be used with other materials such as polymers, or chopped fiber reinforced materials, and composite structures.

The invention includes a stripping system and fastener guide that utilizes a plurality of strip members, preferable constructed of a compressible material. The strip members may be applied to a back side of the lath material. The strip members are used to space the lath away from a support structure, which allows for adjustment of the thickness of the layer of cementitious material behind the lath, i.e., the "base layer" or, alternatively, allows for an area to allow for water to drain. In one embodiment, when cementitious material is applied to the lath, the cementitious material flows through the lath. Strip members are used as a structural spacer. Therefore, the cementitious backing material will be as thick as the strip members. Methods of applying cementitiuos material include hand troweling and mechanical application.

To secure the lath to a support system, such as sheathing, which may be covered by a water/vapor barrier, fasteners are typically used. Typical fasteners include staples or nails, although other fasteners may be used.

In another embodiment, a first water/vapor barrier is attached to a back of the lath. Strip members are attached to the water/vapor barrier. A second water/vapor barrier may be attached to sheathing or to the back of the strip members. The first water/vapor barrier functions as a mortar stop to prevent mortar from migrating to a back side of the lath. The strip members create an open space to facilitate drainage. The strip members also perform a gasket-like function by sealing around the fasteners to prevent water from migrating around the fasteners into communication with the sheathing.

The flexible strip members act as nailing guides for the fasteners. The closer the strip members are spaced, the greater the structural strength becomes, proportional to the amount of fasteners that are used to secure the lath.

A plurality of strip members may be adhered to the back side of the lath. The strip members function as fastener guides and are provided to direct where the fasteners should be placed. The distance between the strip members may be adjusted as necessary to comply with local and national building codes for attachment guidelines, e.g., 16 in on center, 24 inches on center, 12 in on center, etc., according to applicable building code standards.

The strip members may be used in connection with a variety of materials including but not limited to the masonry industry, e.g., tile, countertops, shower surrounds, manufactured stone and natural stone veneers, brick, concrete stairs. The strip members may also be used with other masonry systems.

The nailing strip members may be made of any suitable material that provides adequate gasket, shock absorbing, water channeling and thickness properties. A preferred material for the strip members of the adjustable strip system is a medium density foam, such as EVA (Ethel Vinyl Acetate). Although EVA is currently the material of preference, other materials could be used including silicone, acrylics, foamed or unfoamed, or any other material that has the desired properties. Open celled foam may also be used, but open celled foam is not ideal because it has inferior gasket sealing properties and inferior water channeling capabilities. EVA is preferred because it is a closed cell foam that provides gasket-like sealing properties when anchors or fasteners perforate the water barrier. The foam strip members protect the anchoring device from corrosion due to water exposure and due to concrete alkaline environments.

Strip members are also used as impact reducers for protecting the lath from fastener installation related to impacts which are particularly damaging when pneumatic anchoring systems are used to apply the fasteners. When the fibers that make up a non-metallic lath are impacted and bent, e.g., from impact trauma from staples, nails or other fastening devices, the structural integrity of the non-metallic lath is compromised.

The nailing strip members of the flexible stripping system are used as impact or stress point reducing elements to reduce impact or stress resulting from the fastening process. The impact absorbing nature of a medium density foam prevents fibers that make up a non-metallic lath from being damaged, i.e., the foam protects both mechanical strength degradation due to fiber fractures, and helps to preserve the zirconium dioxide coating from being damaged by impact associated with the anchoring processes.

Most polymer and fiber materials undergo degradation of strength upon blunt force impact such as applied by pneumatic anchoring systems or by anchoring by hand. For example, fiberglass has a high tensile strength but its individual properties are still based on glass material properties. When fiberglass undergoes impact or extreme stress on a point, the tensile strength of this fibrous material can be reduced up to 80% of its original strength. When looking at non-metallic lath systems that incorporate plastics with fibers and plastics without fibers, the degradation of non-metallic materials are similar to the above mentioned fiber damage using pneumatic anchoring systems. The innovation of a flexible stripping anchoring guide will reduce impacts and stress points caused by blunt force trauma of an anchoring system, therefore protecting the structural integrity of the lath system at the anchoring point. The flexible stripping system and nailing guide allows for kinetic energy absorbance and pressure point elongation caused by the anchoring system to be absorbed by the flexible stripping system.

The use of strip members allows the thickness of the base layer of cementitious material to be controlled by the thickness of the strip member. Different thicknesses are available for differing strength applications on the fundamental principals that the thicker the concrete structure, the stronger the substrate. The capability of adjusting the thickness and spacing of the strip members allows for tailoring of structural strengths based on architectural loads and international building codes.

In applications where nailing guides are not used, and the anchoring devices are applied directly to the substrate, the lath can be damaged and the coatings corrosive protection may be removed. When mesh fibers are impacted and bent due to blunt force trauma from staples, nails or other fastening devices, the structural integrity of the mesh fibers is compromised The flexible nailing guides may be applied to the lath by the manufacturer with adhesive. The flexible nailing strip members prevent any protective coating on the fiberglass lath from becoming stripped away, as is common in applications where no strip members are used. The flexible nailing guides can be moved closer together as desired to provide compliance with local and national building codes for attachment guidelines In a preferred embodiment, the strip members are adhered to the lath material, e.g., metallic mesh, non-metallic mesh, entangled fiber panel, etc., in a generally parallel orientation along one surface, e.g., the rear surface, of the mesh. The strip members can be applied either vertically or horizontally. Typically, the strip members are precut and glued on in individual pieces when applied vertically or rolled out in long rolls when applied horizontally, i.e., when applied along the length of the roll of the mesh. The strip members can be applied by the lath manufacturer or may be applied directly on the vapor barrier after the manufacturing process is complete.

When using a non-metallic mesh as the lath material, a preferred material for the non metallic mesh of the invention is an alkali resistant fiberglass. An example material is manufactured by leno weave. A preferred dimension for the non metallic mesh is four feet wide, and 75 feet long, although other dimensions may be used as may be dictated by building code standards. A preferred hole spacing of the mesh is 6.35 mm. However, the opening sizes may be adjusted as conditions warrant. For example, if a new mortar material is developed, e.g., if more acrylic binders or polymers are added or substituted, and the viscosity goes down, the openings of the mesh will need to be reduced in size to better hold the material in the keys of the mesh. Alternatively, if the industry chooses to go with a chopped fiber mortar or material, the viscosity will go up, and the opening size of the structural reinforcement system may need to be increased to allow the material to key properly.

When using a mesh, the limitations of the ability of the cementitious material to flow through the mesh system are believed to be directly proportional to the grid size of the mesh. The smaller grid sizes, such as 5 mm, resulted in air voids in the base layer of the cementitious material, which resulted in an inconsistent base layer. An extreme grid size, having a grid size the size of chicken wire let the cementitious material roll out of the mesh, as there was not enough grid surfaces in place, making the troweling of the scratch coat twice as long, thus increasing the labor costs.

A preferred mesh has a mesh opening size of 6.35 mm×6.35 mm, is lightweight, weighing only 25 pounds per 300 square foot roll. In contrast, 300 square foot of metal lath would be equal to 17 sheets, which weighs approximately 85 pounds and is therefore difficult for one person to handle or carry.

When non-metallic mesh is used, the non-metallic mesh can be cut to length by using a box blade, a pocket knife or even scissors. In contrast, metal lath must to be cut with tin snips or with a grinder. The ease of cutting around outlets, windows, doors and other obstacles when using the mesh of the invention is a substantial improvement over metal lath. Applying the non-metallic lath is safer for the handler of the material as compared to metal lath, which is very sharp and dangerous and can slice the skin very easily.

In another embodiment of the invention, a non-metallic lath is constructed of entangled filament mounted on a fabric backing. An example of this material is Acousti-Mat® 3, available from Maxxon® Corporation (920 Hamel Road, PO Box 253, Hamel, Minn. 55340). In this embodiment, cementitious material is applied to the entangled filament. Strip members may be applied to a rear surface of the fabric backing to create a drain space for water.

In either embodiment, in a preferred application, the strip members are 6.35 mm thick (¼ inch), 12.7 mm (5 inches) wide with a distance between strip members of 15 cm (6 inches center to center).

The lath is preferably applied over a moisture/vapor layer, e.g., 30 lb tar paper, stapled with fasteners, e.g., galvanized staples that have a one inch crown and that are at least one inch long and more preferably 1¼ inches long. The fasteners, such as nails or staples, pass through the strip members, i.e., the strip members are used as a fastening guide. A mortar scratch coat may then be hand troweled onto the lath. A finish coat may then be applied after the scratch coat is dry.

An additional embodiment of the structural reinforcement system of the invention utilizes a water/vapor barrier. Adjustable nailing/anchoring strip members are adhered to back of the mesh. The mesh with the nailing guides attached is then applied over a moisture barrier, which is already attached to the alkali resistant mesh. The mesh and the moisture barrier may then be fastened/mechanically anchored to the sheathing/support structure. In a further alternate embodiment, a second water/vapor barrier is attached directly to the sheathing or to the back of the strip so the strip is sandwiched between two layers of paper.

The nailing strip members can be mechanically fastened to the mesh. Alternatively, the nailing strip members can have a peel off adhesive for adhering to the vapor barrier, then later mechanically fastened. For improved water drainage channeling, the nailing strip members may be adhered directly to the water/vapor barrier.

In a preferred embodiment, the adjustable nailing/anchoring strip members are adhered to back of the mesh. The strip members are then applied over the moisture barrier, which has been previously installed. Then the lath is fastened/mechanically anchored to the sheathing/support structure.

Non-metallic mesh has advantages with respect to prior art metal systems, which had to be hung in a correct orientation to function properly. The mesh of the current invention can be hung in any orientation, which makes installation at least 40% faster.

A non-metallic mesh provides greater coverage per roll as compared to metal lath. The rolls of non-metallic mesh are 4 feet wide, as opposed to the 27 in for metal lath. A mason can carry a roll of non-metallic lath up scaffolding and attach the non-metallic lath at the top of the substrate and let the rest of the roll of lath fall to the ground. The suspended mesh may then be fastened to the substrate. In contrast, metal lath is cumbersome, heavy, and dangerous to transport to great heights.

The installation of a non-metallic lath saves on installation time, thus saving on labor costs. The labor savings is at least 50% over the metal for example a manufactured stone installer, can save over 50% in labor in residential projects, and in some commercial projects that have long straight runs, 80%. The minimum savings on installation is 50%.

The scratch coat is easy to apply on a fiberglass mesh lath material, wherein the troweling of the mud glides over the fiberglass surface. The installation of the strip members of flexible stripping system and nailing guide allow more cement to be pushed behind the non-metallic mesh to create a stronger substrate since the non-metallic mesh becomes embedded between the layers of cementitous material.

In one embodiment, single sided or double sided self adhering flexible nailing guides may function as a drainage system. The drainage system is constructed by adhering the flexible nailing guides to the water/vapor barrier before mechanically fastening or anchoring or installing the lath. The flexible nailing guides may be provided with adhesive surfaces or may be without an adhesive surface. The flexible nailing guides may be previously installed onto the lath wherein the lath and attached nailing guides are mechanically anchored to the structural framing at the same time. In one preferred embodiment, drainage strip members may function as drainage guides. The draining guides may be installed at an angle to horizontal to direct flow of water as desired, e.g., angled drain guides may be placed above a window to prevent pooling of water on horizontal wall structures.

In another embodiment of the structural reinforcement system, the water/vapor barrier can be applied to the lath to form a composite system.

The strip members, when used as a drainage guide, may be constructed of open celled foam to absorb and redirect water flow to facilitate water drainage. These drainage guides can be applied to the vapor/water barrier prior to the lath being applied or can be directly adhered to the lath from the manufacturer.

The system of the present invention incorporates an adjustable thickness flexible\mesh system which increases the amount of cementitious material that can pass through the flexible mesh. The non metallic mesh support substrate system of the invention utilizes a stripping system wherein the thickness of the stripping may be adjusted to match the thickness of the cementitious substrate. The thickness of the stripping may also be adjusted as desired. The strength of the cementitious substrate is proportional to the thickness of the flexible stripping system and anchoring guide.

BRIEF DESCRIPTION OF THE DRAWINGS

FIG. 9 is a front view of a housing structure showing installation of sheathing and a plurality of strip members affixed thereto when the strip members comprise nail guides and drainage strip members.

FIG. 10 is an enlarged view of the non-metallic lath of FIGS. 1-6 showing a fastener penetrating a strip member.

DETAILED DESCRIPTION OF THE PREFERRED EMBODIMENTS

Figure 1A:
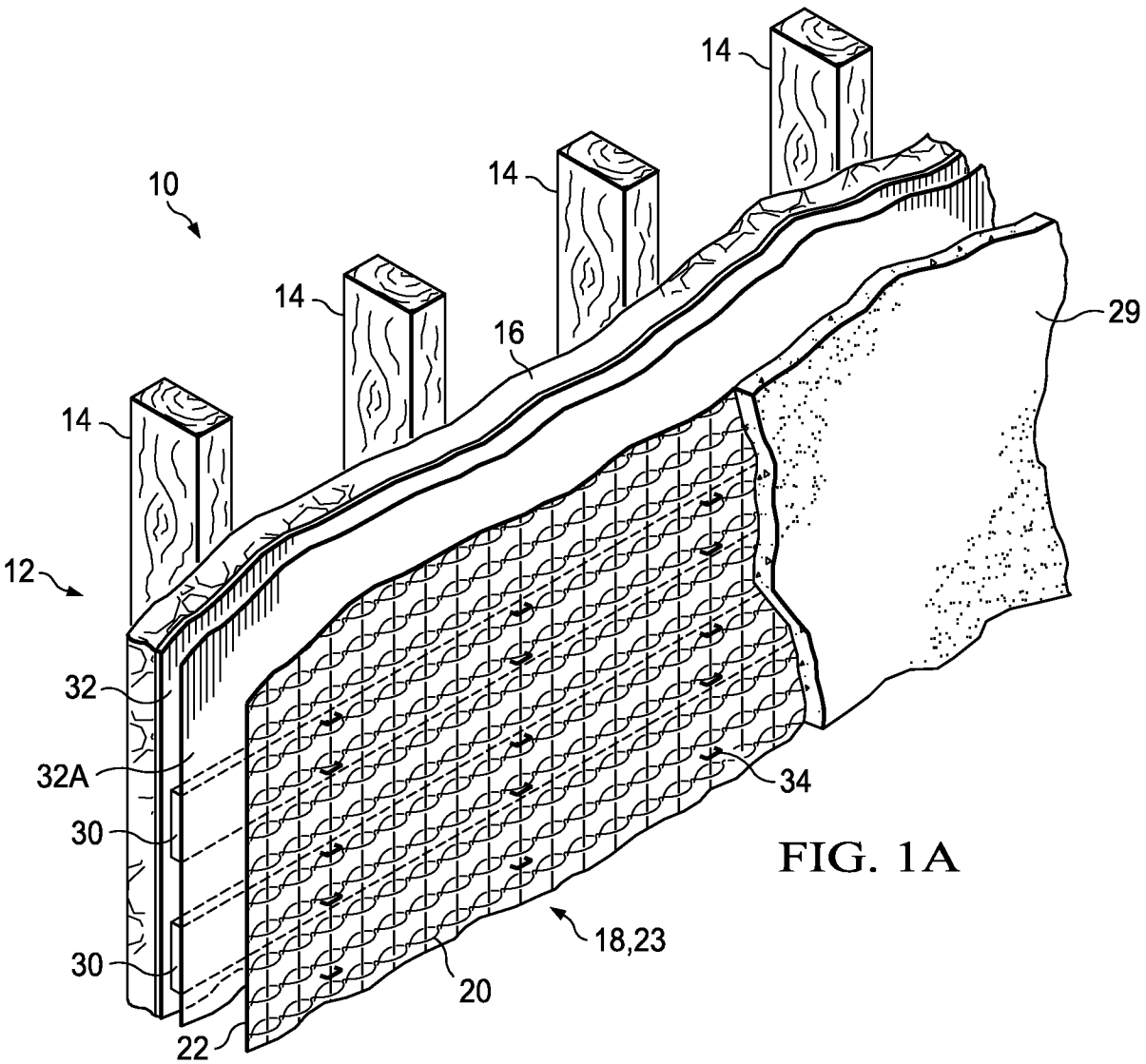
FIG. 1A is a partial cutaway view of one embodiment of a structural reinforcement system of the invention wherein a mesh is used as a lath material having a plurality of strip members separating the mesh from a moisture/vapor barrier and a second moisture/vapor barrier between the strip members and the mesh wherein the second moisture/vapor barrier functions as a mortar stop.
Figure 1B:
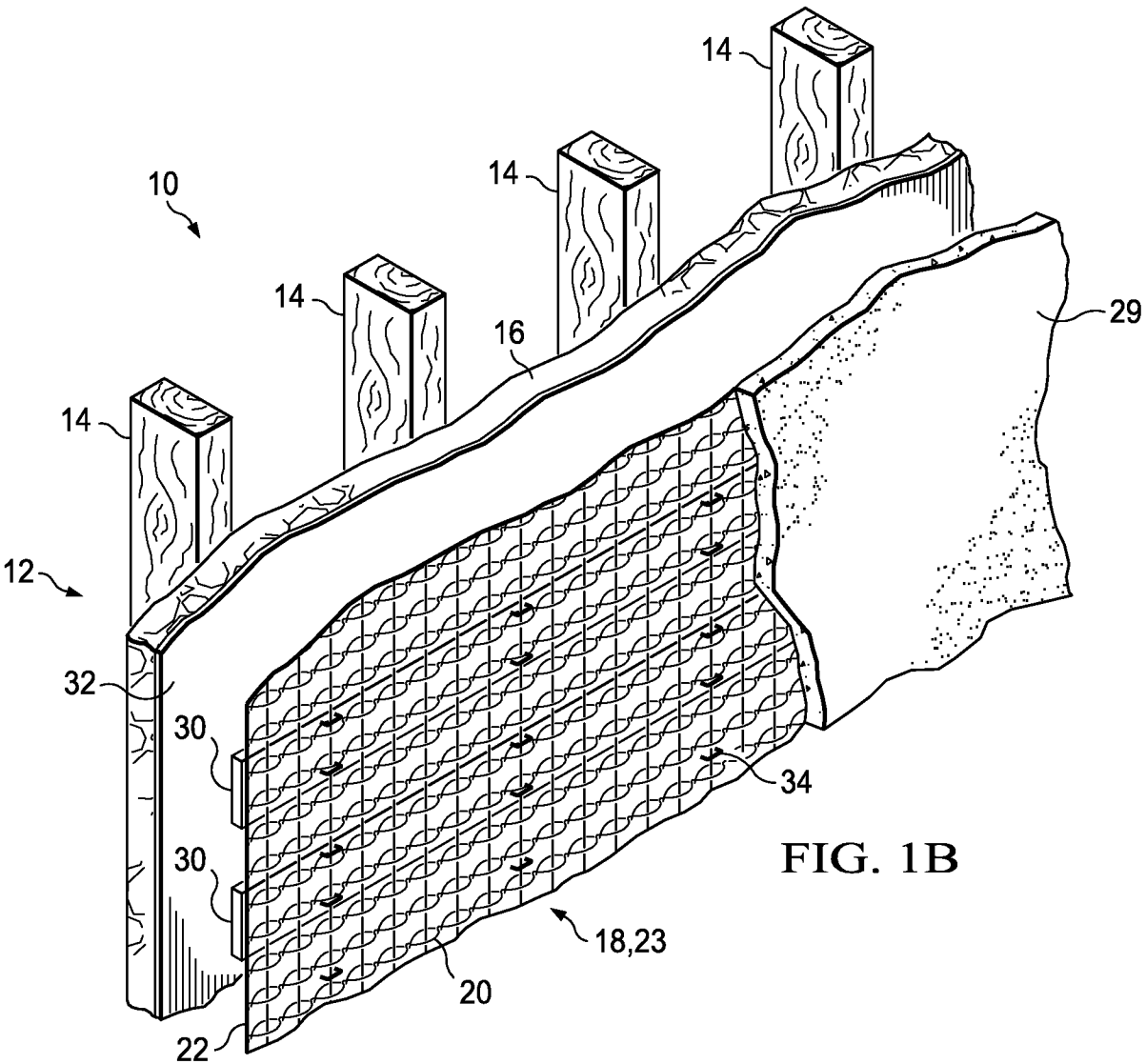
FIG. 1B is a partial cutaway view of one embodiment of a structural reinforcement system of the invention wherein a mesh is used as a lath material having a plurality of strip members separating the mesh from a moisture/vapor barrier.
Figure 2:
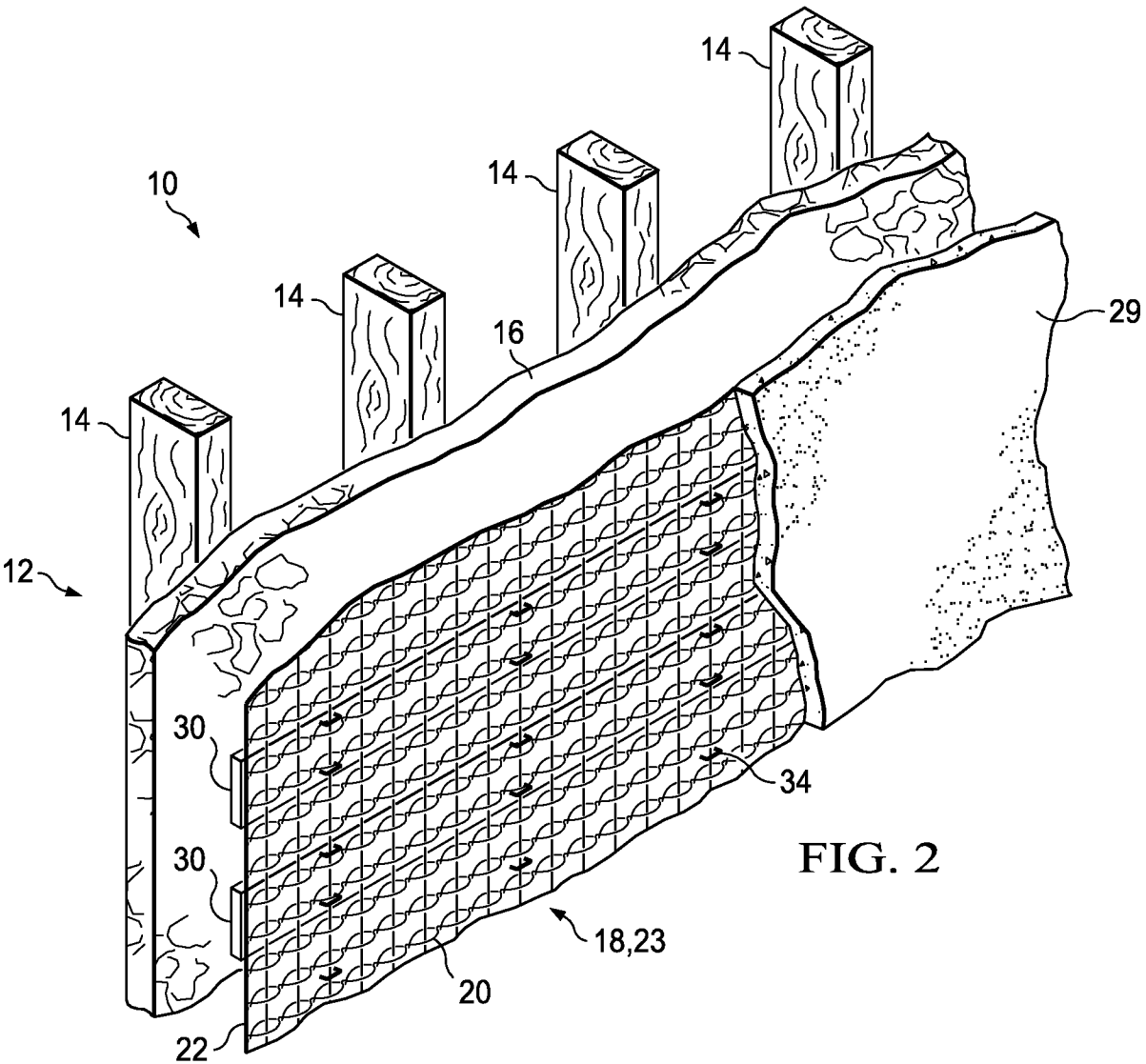
FIG. 2 is a partial cutaway view of one embodiment of a structural reinforcement system of the invention wherein a mesh is used as a lath material having a plurality of strip members separating the mesh from a support structure.
Figure 5:
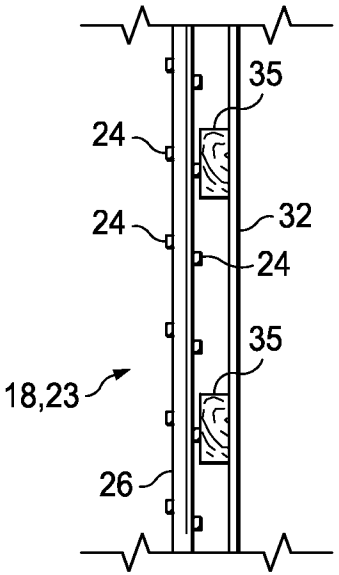
FIG. 5 is a side view of the lath portion of FIG. 3.
Figure 4:
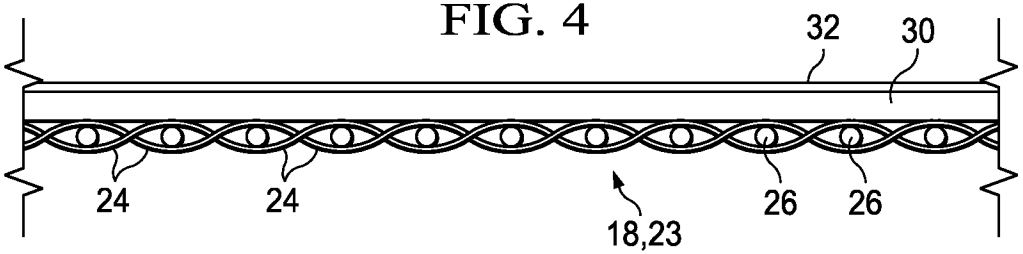
FIG. 4 is a top view of the lath portion shown in FIG. 3.
Figure 3:
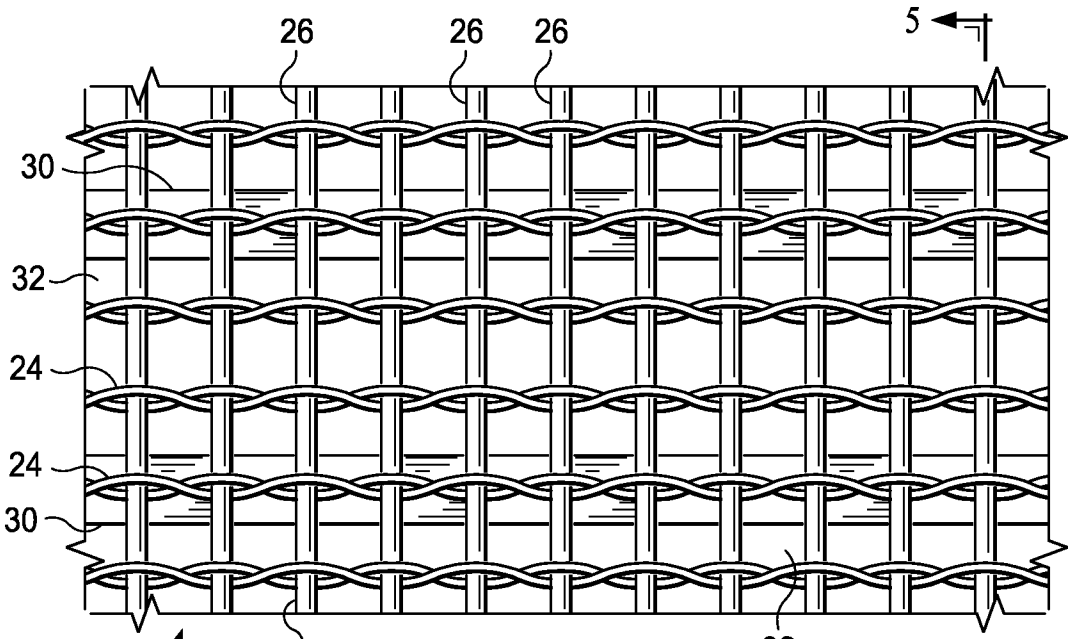
FIG. 3 is an enlarged view of the lath portion of FIG. 1.

Referring now to FIG. 1B, the structural reinforcement system 10 of the invention is shown. Structural reinforcement system 10 is affixed to support structure 12. Support structure 12 typically is made up of a plurality of studs 14 which may be covered with sheathing 16. An example of sheathing 16 is oriental strand board (OSB). A lath 18 is located adjacent to support structure 12. Lath 18 has a front surface 20 and a rear surface 22.

In one embodiment (FIGS. 1A-6) lath 18 is a mesh structure 23. Mesh structure 23 may be a metal lath or a non-metallic lath. In the embodiment wherein lath 18 is a non-metallic lath, mesh structure 23 includes a first group of a plurality of strands 24 (best shown in FIGS. 3-6) that are generally parallel to one another, e.g., horizontal strands. Mesh structure 23 further includes a second group of strands 26 that are generally parallel to one another and transverse to the first group of plurality of strands 24, e.g., vertical strands. First group of strands 24 and second group of strands 26 are woven together or heat sealed or otherwise generally secured to form a mesh or netting. The preferred construction of mesh structure 23 is a leno weave. A preferred mesh structure 23 has a zirconium dioxide content of at least 14.5% and a weight of 300 grams per square meter. In a preferred embodiment, each of strands 24, 26 are made up a plurality of individual fiberglass fibers. Although the strands 24, 26 are shown generally parallel to one another, it should be understood that other orientations are also possible.

In a preferred embodiment, the first group of a plurality of strands 24 that make up mesh structure 23 are given a slight twist so that there is a slight bit of cupping in the strand on the outer surface of mesh structure 23. This cupping mimics the bow that is usually found on metal lath. In many applications where lath 18 is used there is, for example, a support structure 12, such as a series of studs 14 that form a matrix for receiving sheets of sheathing 16. Over sheathing 16 is usually placed a vapor barrier 32 such as Tyvek® or tar paper or other sheet material. Over the sheathing 16 or the sheet material lath 18 is placed. Lath 18 is secured to the support structure 12 by any suitable fastener 34 such as nailing tacks, staples, screws or other fasteners that are accepted by national building code standards. In prior art applications lath 18 is secured directly to the sheathing 16. Since lath 18 is generally in contact with the sheathing 16 or sheet material, there is not a great deal of space, if any, between lath 18 and the sheets or sheaths 16. A problem that arises is that the absence of space behind the lath 18 makes it difficult for a cementitious material 29, such as stucco, plaster, mortar and/or adhesive to key properly to the lath 18.

Figure 8:
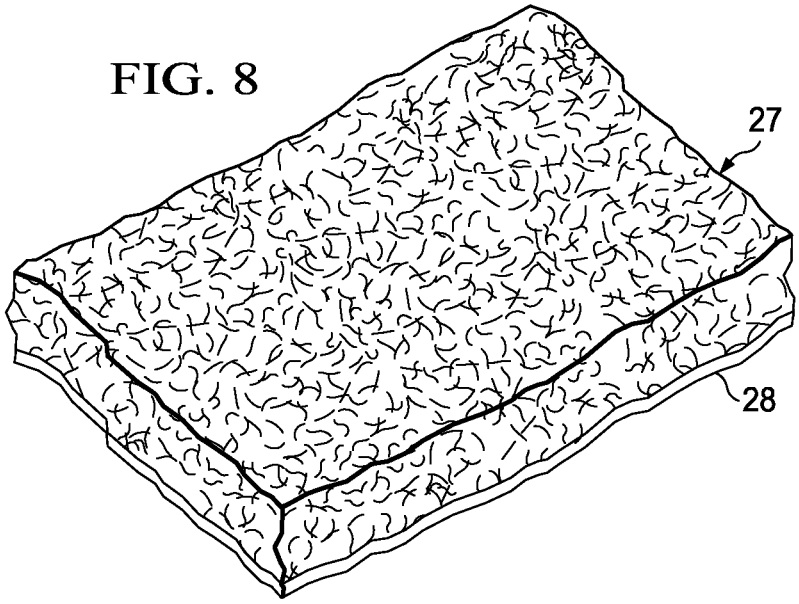
FIG. 8 is a perspective view of a section the entangled filament of FIG. 7.
Figure 7:
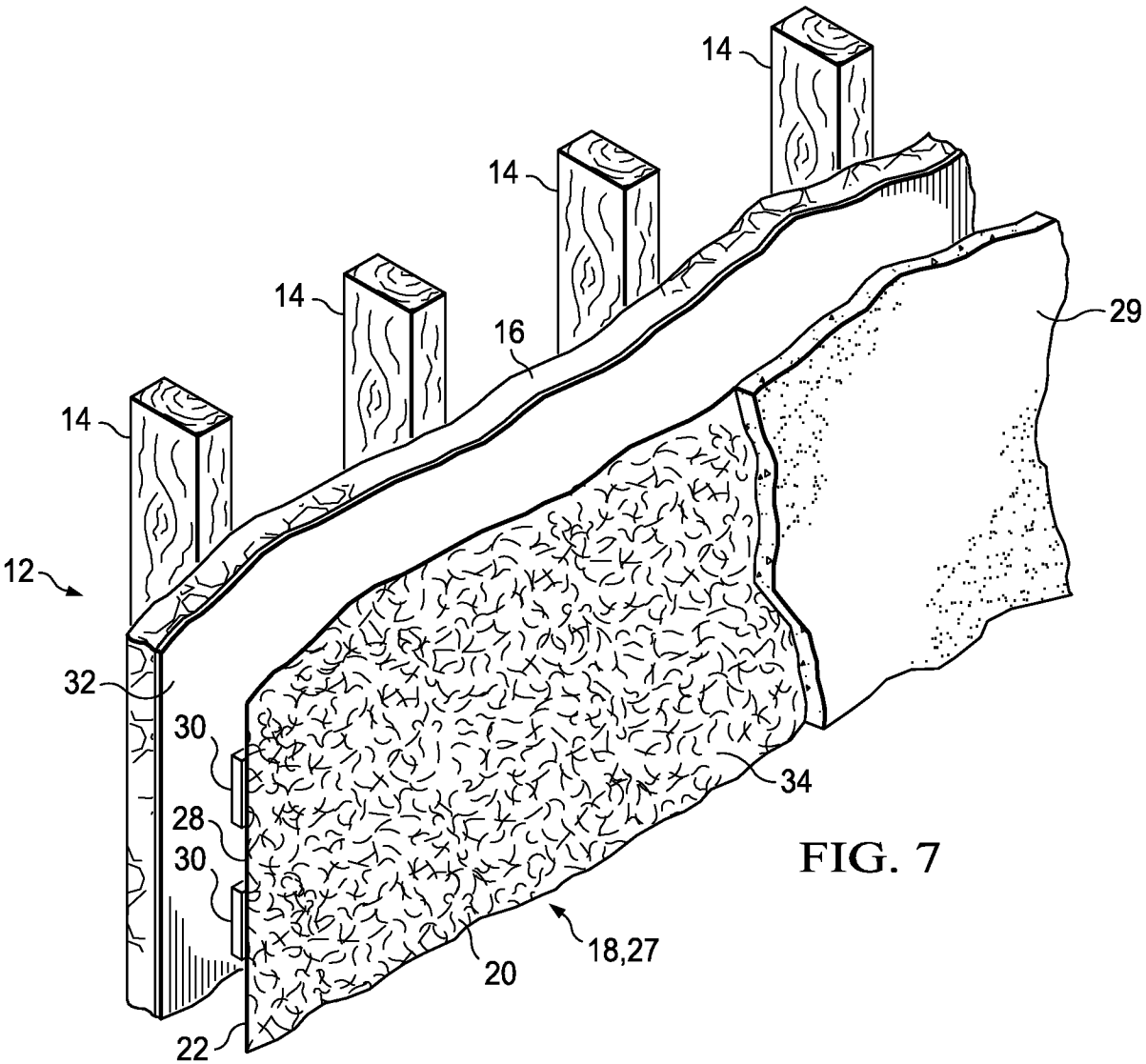
FIG. 7 is a partial cutaway view of another embodiment of a structural reinforcement system of the invention wherein a sheet of entangled filament is used as a lath having a plurality of strip members separating the entangled filament sheet from a moisture/vapor barrier.

In a further embodiment (FIGS. 7, 8), lath 18 is a non-metallic entangled filament 27 mounted on a fabric backing 28. An example of this material is Acousti-Mat® 3, available from Maxxon® Corporation (920 Hamel Road, PO Box 253, Hamel, Minn. 55340).

Front surface 20 of lath 18 is the surface to which cementitious material 29 (FIGS. 1A, 1B, 2, 7) is to be applied. Rear surface 22 preferably has one or more strip members 30 affixed thereto and may include a water/vapor barrier 32. Strip members 30 are preferably formed of a compressible material such as EVA, foam, or polystyrene. When structural reinforcement system 10 is assembled, strip members 30 separate lath 18 from support structure 12 to which lath 18 is secured. Typically, strip members 30 have an adhesive that secures strip member 30 to rear surface 22 of lath 18. Preferably, the adhesive is one that permits strip members 30 to be readily removed from contact with lath 18 so that spacing of strip members 30 can be adjusted as needed.

In the embodiment wherein mesh structure 23 functions as lath 18, a portion of cementitious material 29 passes through mesh structure 23 to form a base layer and for encapsulating mesh structure 23.

Cementitious material 29 encapsulates the mesh structure 23, with the space between the mesh structure 23 and sheathing 16 or water/vapor barrier 32 allowing the full encapsulation of mesh structure 23 in the cementitious material 29. The spacer provided by strip members 30 permit more of the cementitious material 29 to pass through the mesh structure 23 than is normally achieved.

Structural reinforcement system 10 may further include a water/vapor barrier 32 adjacent to support structure 12. In a preferred embodiment, water/vapor barrier 32 is located between support structure 12 and rear surface 22 of lath 18.

In some applications, a water/vapor barrier 32, such as a sheet of tar paper, is placed over sheathing 16 or sheet material. Lath 18 with optionally attached strip members 30 may be applied over the sheathing 16. In another version of the current invention shown in FIG. 1A, a water/vapor barrier 32 is already directly attached to lath 18 and strip members 30 are attached thereon. Strip members 30 are applied to a second water/vapor barrier 32A simultaneously, thereby eliminating an added step of separately the second said water/vapor barrier 32A.

Fasteners 34 (FIGS. 1A, 1B, 2, 6, 7 and 10) penetrate the plurality of strip members 30 for affixing strip members 30 and lath 18 to support structure 12. When water/vapor barrier 32 is utilized, fasteners 34 penetrate plurality of strip members 30 and secure lath 18 and water/vapor barrier 32 to support structure 12. Lath 18 is preferably applied with fasteners every 6 inches on the perimeter and every 12 inches on the field.

Strip members 30 are preferably comprised of a material that provides a gasket-like water-tight seal around fasteners 34 when fasteners 34 penetrate strip members 30 for securing lath 18 to support structure 12. The water-tight seal around fasteners 34 by strip members 30 functions to seal out moisture and to protect fasteners 34 from exposure to alkaline substances. Additionally, the seal formed around fasteners 34 prevents moisture from entering and penetrating into support structure 12.

An additional property of strip members 30 is that strip members 30 are capable of absorbing impacts associated with installing fasteners 34. Impact absorption by strip members 30 prevents lath 18 from being damaged. Damage which may occur to lath 18 includes structural damage due to impact of installing fasteners 34. Additional damage that may occur during installation of fasteners 34 is the inadvertent removal of a corrosion resistant coating on mesh 18.

Strip members 30 may be attached to support structure 12 before lath 18 is attached to support structure 12. Strip members 30 may also be applied to lath 18. Strip members 30 may be applied to anything that is used in the construction of the structural support system 10. For example, strip members 30 may be applied to building paper or water/vapor barrier 32 and adhered before the structural support system 10 is constructed. A first sheet of water/vapor barrier 32 is affixed to lath 18 and functions as a mortar stop. A second sheet of water/vapor barrier 32A (FIG. 1A) is affixed to sheathing 16 and is used as a moisture barrier. In this embodiment, strips 30 are provided to serve spacing and gasket functions. Strips 30 may be used with metal or non-metallic embodiments of lath 18.

Strip members 30 may also be affixed to lath 18 prior to attachment of lath 18 to support structure 12. Structural reinforcement system 10 is adjustable in that strip members 30 may be affixed to lath 18 at desired spacing to meet construction requirements. Additionally, strip members 30 may be oriented in a vertical or horizontal configuration as desired.

Strip members 30 may be used both as fastener guides 35 and as drainage guides 37 (FIG. 9). Fastener guides 35 are preferably made up of a closed cell foam material that forms a water-tight seal around fastener 34. Drainage guides 37 are preferably made up of an open cell foam that is absorbent. In one embodiment, drainage guides 37 are oriented so that after lath 18 is attached to support structure 12 with fasteners 34, drainage guides 37 are non-horizontal and non-vertical for directing water that passes behind lath 18 may be directed as desired. As an example, drainage guides 37 may be located above a window or door in a structure as shown in FIG. 9 to prevent pooling of liquids above the window or door.

Figure 6:
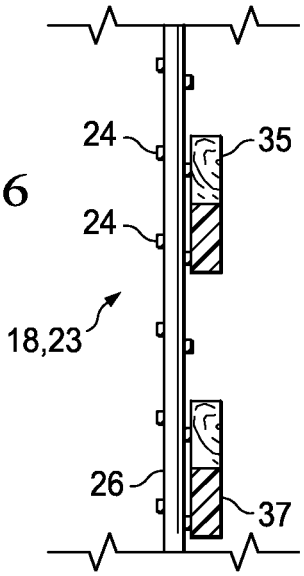
FIG. 6 is a side view of an alternate embodiment of the structural reinforcement system including open celled absorbent strip members.

Strip members 30 may also be used as a combination of fastener guides 35 and drainage guides 37 installed in parallel, as shown in FIG. 6, so that any liquids that are behind lath 18 may be absorbed and redirected by the open celled foam of the drainage guides 37. Strip members 30 may be installed, one on top of another wherein a strip member 30 of closed cell foam is located adjacent to sheathing 16 or water/vapor barrier 32 and strip members 30 of open cell foam is located adjacent to mesh 18 so that strip members 30 of open cell foam allow for drainage.

In practice, the structural reinforcement system 10 of the invention may be installed by affixing a plurality of strip members 30 to lath 18, such as rear surface 22 of mesh structure 23 or backing 28 of entangled filament 27. Lath 18 with attached strip members 30 may then be located on a support structure 12. A water/vapor barrier 32 may be affixed to support structure 12 or may be attached to strip members 30 and lath 18 for simultaneous installation. Alternatively, a first water/vapor barrier 32 may be attached to a back of lath 18 to function as a mortar stop and a second water/vapor barrier 32*a* may be attached to sheathing 16.

Fasteners 34 are then used to fastening lath 30 to support structure 12 wherein fasteners 34 pass through strip members 30 before engaging support structure 12. If water/vapor barrier 32 is used, fasteners 34 will penetrate water/vapor barrier 32 prior to engaging support structure 12. During application of fasteners 34, strip members 30 absorb the impact of the fastening process, thereby protecting said lath 18. Cementitious material 29 may then be applied to lath 18.

FIG. 10 shows lath 18 and strip members 30 attached to the sheathing 16 with fastener 34, e.g., a staple. The strip member 30 functions as a fastener and guide 35 to absorb the impact of fastener 34 and allows the cementitious material 29 to encapsulate the mesh structure 23 in a full bed of cementitious material 29. The webbing of the mesh structure becomes flexed, but the strands 24, 26 are not damaged.

In the embodiment wherein mesh structure 23 is used as lath 18 is mesh structure 23, a thickness of strip members 30 may be selected so that space behind mesh structure 23 is also selected, thereby regulating a thickness of a base layer of cementitious material 29 that migrates in between mesh structure 23 and support structure 12.

In the embodiment wherein entangled filament 27 is used as a non-metallic embodiment of lath 18, strip members 30 are placed behind backing 28 of entangled filament 27 to create a void for allowing moisture to flow between the lath 18 and the cementitious material 29 without impediment.

As explained above, fasteners 34 are passed through strip members 30, which serve as fastener guides 35. Strip members 30 form a seal against fasteners 34 to prevent moisture from passing around said fastener. Strip members 30 additionally seal fasteners 34 against exposure to alkaline substances that may be present in cementitious material 29.

Strip members 30 may be used as drainage guides 37 wherein strip members 30 are oriented in a non-horizontal and non-vertical orientating for directing water that passes behind said lath. Alternatively, Strip members 30 may be constructed of an open celled foam and placed adjacent to or on top of strip members 30 of closed cell foam so that the drainage guides 37 function to redirect water.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A method of installing a structural reinforcement system comprising the steps of:

affixing a plurality of spaced apart flexible and compressible impact absorbing strip members directly to a lath, said strip members having a flexible lath contacting surface affixed to a rear surface of said lath, thereby producing a composite system;

after said step of affixing, locating said composite system on a support structure;

fastening said composite system to said support structure with fasteners;

wherein said fasteners pass through said strip members before engaging said support structure.

2. The method according to claim 1 further comprising the step of:

applying a cementitious material to said lath.

3. The method according to claim 1 further comprising:

absorbing an impact of said step of fastening and elongating a pressure point, with said flexible lath contacting surface of said flexible impact absorbing strip, thereby protecting said lath;

wherein said flexible impact absorbing strip is comprised of a single compressible material; and wherein said lath is comprised of non-metallic material.

4. The method according to claim 1 further comprising the step of:

selecting a thickness of said strip member to regulate a thickness of a base layer of cementitious material that migrates in between said lath and said support structure.

5. The method according to claim 1 wherein:

said fasteners also pass through a water/vapor barrier before engaging said support structure.

6. The method according to claim 1 further comprising the step of:

sealing said fasteners with said strip member to prevent moisture from passing around said fastener.

7. The method according to claim 1 further comprising the step of:

sealing said fasteners with said strip member to protect said fastener from exposure to alkaline substances.

8. The method according to claim 1 wherein:

said step of passing said fasteners through said strip member comprises passing multiple fasteners through each of said plurality of strip members;

said step of affixing said plurality of strip members to a lath includes orienting a strip member so that after said step of fastening said lath to said support structure with fasteners, said strip member is non-horizontal and non-vertical for directing water.

9. The method according to claim 2 wherein:

said step of applying a cementitious material to said lath comprises encapsulating said lath by forming a base layer of cementitious behind said lath.

10. The method according to claim 8 further comprises the step of:

regulating a thickness of said base layer by selecting a desired thickness of said strip member.

11. The method according to claim 8 wherein:

said step of affixing a plurality of strip members to a lath comprises the step of selecting a desired spacing for said strip members so that said fasteners will have a desired spacing to satisfy spacing requirements.

12. The method according to claim 1 further comprising a step of:

affixing a water/vapor barrier to said support structure.

13. The method according to claim 1 further comprising a step of:

affixing a water/vapor barrier between said strip members and said lath; wherein said step of affixing a plurality of strip members to said lath includes affixing said strip members to said water/vapor barrier affixed to said lath; and wherein said step of fastening said lath to said support structure includes fastening said lath, said water/vapor barrier and said strip members to said support structure as a unit;

wherein said fasteners pass through said strip members for absorbing impact associated with installing fasteners.

14. The method according to claim 1 wherein:

said strip members are first adhered to said lath and then mechanically fastened to said lath.

15. The method according to claim 2 wherein:

said step of applying cementitious material includes flowing said cementitious material through the lath until a portion of said cementitious material behind said lath is as thick as said strip members.

16. The method according to claim 1 wherein:

said lath is non-metallic.

17. The method according to claim 1 further comprising:

after said step of affixing said strip members to said lath to produce said composite system, rolling said composite system for easily transporting and for easy unrolling for easy installation.

18. The method according to claim 1 further comprising:

after said step of affixing said strip members to said lath to produce said composite system, attaching a moisture barrier to said composite system, then rolling said composite system and attached moisture barrier for easily transporting and for easy unrolling for easy installation.

* * * * *

UNITED STATES PATENT AND TRADEMARK OFFICE

CERTIFICATE OF CORRECTION

PATENT NO. : 9,145,688 B2
APPLICATION NO. : 13/408844
DATED : September 29, 2015
INVENTOR(S) : Hunt-Hansen et al.

It is certified that error appears in the above-identified patent and that said Letters Patent is hereby corrected as shown below:

Title Page

On the front page of the patent, in item (73), please correct the abbreviation for the state of Arkansas, as follows:

Replace "AK" with --AR--.

Signed and Sealed this
Twenty-third Day of February, 2016

Michelle K. Lee

Michelle K. Lee
*Director of the United States Patent and Trademark Office*